US008794713B2

(12) United States Patent
Manici

(10) Patent No.: US 8,794,713 B2
(45) Date of Patent: Aug. 5, 2014

(54) COSMETIC APPLICATOR BRUSH

(75) Inventor: Davide Manici, Beverate di Brivio (IT)

(73) Assignee: Albea Services, Gennevilliers (FR)

( * ) Notice: Subject to any disclaimer, the term of this patent is extended or adjusted under 35 U.S.C. 154(b) by 288 days.

(21) Appl. No.: 12/957,502

(22) Filed: Dec. 1, 2010

(65) Prior Publication Data

US 2011/0154597 A1 Jun. 30, 2011

(30) Foreign Application Priority Data

Dec. 2, 2009 (EP) ..... 09306172

(51) Int. Cl.
*A46B 3/18* (2006.01)
*A46D 3/00* (2006.01)

(52) U.S. Cl.
USPC ..... 300/21; 15/206; 132/218

(58) Field of Classification Search
CPC .. A46B 9/021; A46B 2200/1053; A46B 3/18; A46B 2200/1046
USPC ..... 132/218, 320; 15/207.2, 206; 300/21
See application file for complete search history.

(56) References Cited

U.S. PATENT DOCUMENTS

| | | | | |
|---|---|---|---|---|
| 5,551,456 | A * | 9/1996 | Hartel | 132/218 |
| 5,595,198 | A * | 1/1997 | Kemmerer | 132/218 |
| 5,709,230 | A * | 1/1998 | Miraglia | 132/218 |
| 6,279,583 | B1 * | 8/2001 | Neuner | 132/218 |
| 6,295,994 | B1 * | 10/2001 | Thayer et al. | 132/218 |

(Continued)

FOREIGN PATENT DOCUMENTS

| | | |
|---|---|---|
| EP | 0 306 052 | 3/1989 |
| EP | 0 410 821 | 1/1991 |

(Continued)

OTHER PUBLICATIONS

Search Report received for corresponding European Application 09 30 6172, dated Jul. 29, 2010.

*Primary Examiner* — Joseph J Hail
*Assistant Examiner* — Marc Carlson
(74) *Attorney, Agent, or Firm* — Banner & Witcoff, Ltd.

(57) ABSTRACT

A cosmetic applicator brush is provided comprising a brush stem and a plurality of fiber arrays extending from the brush stem. The plurality of fiber arrays comprises at least a first zone defining at least a first pitch between adjacent fiber arrays located within the first zone, and at least a second zone defining at least a second pitch between adjacent fiber arrays located within the second zone, with the at least first pitch being different to the at least second pitch. The invention further discloses a method of manufacturing a cosmetic applicator brush, the method comprising using a stem pin to retain a multiplicity of fibers, in a primary twisting step, twisting the stem pin to form a twisted stem pin with a plurality of fiber arrays extending from the twisted stem pin, fixing a first region of the twisted stem pin, such that said first region is unable to twist further, the first region defining at least a first zone of the cosmetic applicator brush, the at least first zone in turn defining at least a first pitch between adjacent fiber arrays located within the first zone, and in a secondary twisting step, twisting a second region of the twisted stem pin to define at least a second zone of the cosmetic applicator brush, the at least second zone in turn defining at least a second pitch between adjacent fiber arrays located within the second zone, with the at least first pitch being different to the at least second pitch.

9 Claims, 3 Drawing Sheets

(56) References Cited

U.S. PATENT DOCUMENTS

| | | | | |
|---|---|---|---|---|
| 6,299,371 | B1 * | 10/2001 | Gueret | 401/122 |
| 6,394,678 | B2 * | 5/2002 | Schrepf | 401/126 |
| 6,616,366 | B1 * | 9/2003 | Weihrauch | 401/286 |
| 7,254,860 | B2 * | 8/2007 | Dumler et al. | 15/207.2 |
| 2001/0046406 | A1 * | 11/2001 | Schrepf | 401/126 |
| 2004/0112400 | A1 * | 6/2004 | Kurek | 132/218 |
| 2005/0066990 | A1 * | 3/2005 | Rousselet | 132/218 |
| 2007/0157945 | A1 * | 7/2007 | Lhoyer et al. | 132/218 |
| 2008/0011317 | A1 * | 1/2008 | Malvar et al. | 132/218 |
| 2008/0023024 | A1 * | 1/2008 | Manici et al. | 132/320 |
| 2008/0041407 | A1 * | 2/2008 | Kearney | 132/218 |
| 2008/0083421 | A1 * | 4/2008 | Malvar et al. | 132/218 |
| 2008/0245385 | A1 * | 10/2008 | Schrepf | 132/218 |
| 2009/0071500 | A1 * | 3/2009 | Wyatt et al. | 132/218 |
| 2010/0051045 | A1 * | 3/2010 | Lhoyer | 132/218 |
| 2010/0192320 | A1 * | 8/2010 | Borsari et al. | 15/206 |
| 2010/0294299 | A1 * | 11/2010 | Gueret | 132/218 |
| 2011/0067725 | A1 * | 3/2011 | Manici | 132/218 |
| 2011/0168204 | A1 * | 7/2011 | Gueret | 132/218 |
| 2012/0006349 | A1 * | 1/2012 | Iwao | 132/218 |
| 2012/0198639 | A1 * | 8/2012 | Smith | 15/104.05 |

FOREIGN PATENT DOCUMENTS

| | | | | |
|---|---|---|---|---|
| EP | 0 663 161 | A1 | 7/1995 | |
| FR | 2 605 505 | | 10/1986 | |
| FR | 2 637 472 | | 10/1988 | |
| WO | 01/58309 | | 8/2001 | |
| WO | 2004/060103 | | 7/2004 | |
| WO | WO 2004060103 | A2 * | 7/2004 | |
| WO | 2009/141098 | | 11/2009 | |
| WO | WO 2009141098 | A1 * | 11/2009 | A46B 9/02 |

* cited by examiner

COSMETIC APPLICATOR BRUSH

FIELD OF THE INVENTION

This invention relates to cosmetic applicator brushes having defined zones, each zone having either a fixed or a variable pitch between adjacent fiber arrays located therein, and to a method of manufacturing such brushes.

BACKGROUND TO THE INVENTION

Cosmetic applicator brushes, and in particular mascara applicator brushes are typically twisted wire brushes. During manufacturing, a multiplicity of fibers is retained between two sides of a stem pin that has been bent and folded back on itself. Once the multiplicity of fibers is in place, the stem pin is then twisted. The twisting of the stem pin causes the multiplicity of fibers to become helicoidally distributed into helicoidal fiber arrays. Typically, in a standard mascara applicator brush, the distance between corresponding points on adjacent fiber arrays, also known as the pitch, is fixed along the length of the brush.

The pitch between adjacent fiber arrays in the assembled brush defines a fiber distribution array. The fiber distribution array affects the amount of mascara that can be loaded onto the brush, and therefore mascara application (both in amount and distribution) is affected. A more tightly twisted brush tends to load less mascara than a brush that is not as tightly twisted. Due to the fact that the pitch between adjacent fiber arrays in standard, assembled cosmetic applicator brushes is fixed along the entire length of the assembled brush, the amount of product loaded by the brush is substantially the same. As a result, the amount of mascara that can be applied by various regions of the brush cannot readily be varied.

OBJECT OF THE INVENTION

It is an object of the invention to provide for a cosmetic applicator brush with defined zones, each zone having either a fixed or a variable pitch between adjacent fiber arrays located within the zones, and to a method of manufacturing such brushes, which at least in part obviates the problems stated above.

SUMMARY OF THE INVENTION

In accordance with a first aspect of the invention there is provided a cosmetic applicator brush comprising:

- a brush stem;
- a plurality of fiber arrays extending from the brush stem, the plurality of fiber arrays comprising:
  - at least a first proximal zone defining at least a first pitch between adjacent fiber arrays located within the first zone; and
  - at least a second distal zone defining at least a second pitch between adjacent fiber arrays located within the second zone, with the at least first pitch being different to the at least second pitch.

In an embodiment, the at least first pitch is less than the at least second pitch. Alternatively, in another embodiment, the at least first pitch is greater than the at least second pitch.

In an embodiment, a plurality of pitches between adjacent fiber arrays located within the first zone is defined. Alternatively, in another embodiment, a plurality of pitches between adjacent fiber arrays located within the second zone is defined.

In one version, the pitch between adjacent fiber arrays within a zone varies linearly.

In accordance with a second aspect of the invention there is provided a method of manufacturing a cosmetic applicator brush comprising:

- using a stem pin to retain a multiplicity of fibers;
- in a primary twisting step, twisting the stem pin to form a twisted stem pin with a plurality of fiber arrays extending from the twisted stem pin;
- fixing a first region of the twisted stem pin, such that said first region is unable to twist further, the first region defining at least a first zone of the cosmetic applicator brush, the at least first zone in turn defining at least a first pitch between adjacent fiber arrays located within the first zone; and
- in a secondary twisting step, twisting a second region of the twisted stem pin to define at least a second zone of the cosmetic applicator brush, the at least second zone in turn defining at least a second pitch between adjacent fiber arrays located within the second zone, with the at least first pitch being different to the at least second pitch.

In an embodiment, the multiplicity of fibers is retained in a uniform distribution such that the distance between adjacent fibers is fixed, so as to define a uniform distribution of fiber arrays extending from the twisted stem pin.

Alternatively, the multiplicity of fibers is retained in a non-uniform distribution such that the distance between adjacent fibers is variable, so as to define a variable distribution of fiber arrays extending from the twisted stem pin.

In an embodiment, the stem pin, in the primary twisting step, is twisted between 11 and 18 times.

In an embodiment, the stem pin, in the secondary twisting step, is twisted between 1 and 4 times.

In an embodiment, the fiber arrays are trimmed after the secondary twisting step. Alternatively, the fiber arrays are trimmed before the secondary twisting step.

DETAILED DESCRIPTION OF THE DRAWINGS

Figure 1A:
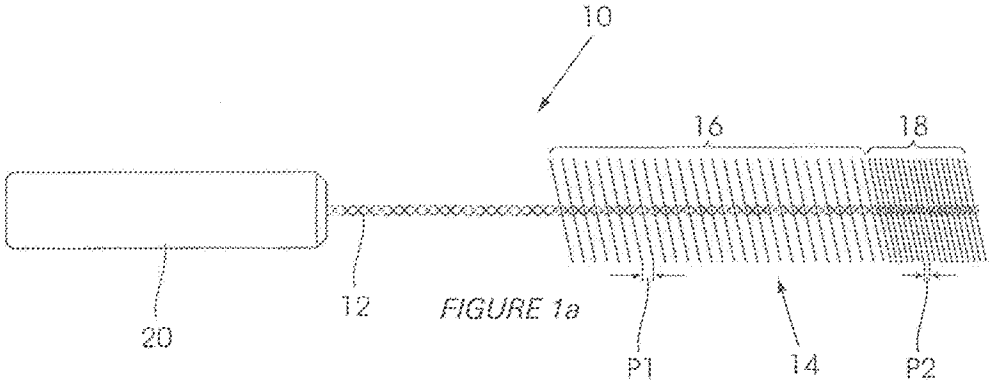
FIGS. 1*a* to 1*d* show side views of various embodiments of a cosmetic applicator brush according to the invention.

In FIG. 1*a*, a cosmetic applicator brush (10), more particularly a mascara brush, in accordance with a first aspect of the invention is shown. The cosmetic applicator brush (10) has a brush stem (12) and a plurality of fiber arrays (14) extending from the brush stem (12). The brush stem (12) has an elongate shape with a first end (or proximal end) intended to be fixed to a handle and a second end (or distal end) which is free. The plurality of fiber arrays (14) are helicoidally arranged around the stem (12), but for the sake of clarity, are shown as extending radially away from the stem (12). The fiber arrays (14) are divided into at least a first proximal zone (16) and at least a second distal zone (18). The terms "proximal" and "distal" means that the first zone (16) and the second zone (18) are located relative to each other along the length of the brush stem (12) such that the first zone (16) is located closer to the first end of the brush stem (12) than the second zone (18). The first zone (16) defines a first fixed pitch (P1) between adjacent fiber arrays (14) located within the first zone (16). Similarly, the second zone (18) defines a second fixed pitch (P2) between adjacent fiber arrays (14) located within the second zone (18).

The pitches P1 and P2 differ, so that the pitch between adjacent fiber arrays varies between the first zone (16) and the second zone (18). The cosmetic applicator brush (10) is generally mounted to a cap (20). The cap (20) can be used as a handle when a user applies the mascara product to their eyelashes. As is well known, the cap (20) can be used to close a container (not show) containing the mascara product when the mascara product is being stored, thereby preserving the mascara product.

In one version, as shown in FIG. 1*a*, P1 is greater than P2. This results in the first zone (16) to be more loosely twisted and the second zone (18) to be more tightly twisted. Due to the fact that the second zone (18) is more tightly twisted, in use, it becomes loaded with less mascara than the first zone (16), and hence the distribution of mascara along the length of the cosmetic applicator brush (10) varies.

Figure 1B:
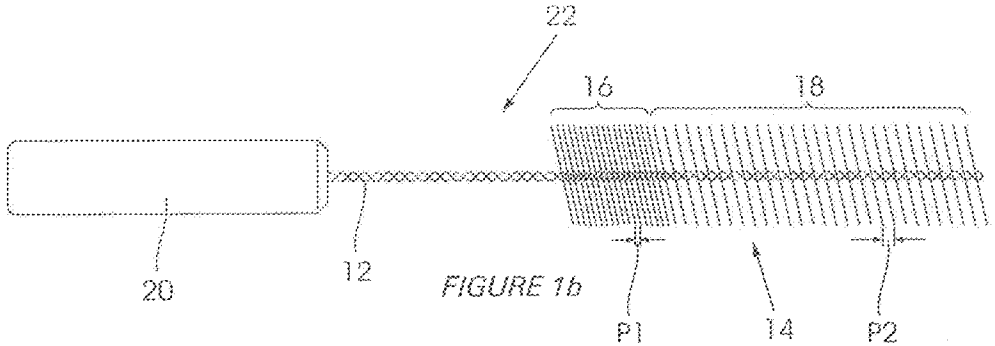

In an alternate brush (22), as shown in FIG. 1*b*, P1 is less than P2, thereby causing the first zone (16) to be more tightly twisted than the second zone (18). In this embodiment, in use, the second zone (18) becomes loaded with more mascara than the first zone (16).

Referring now to FIG. 1 *c*, it is envisaged that a cosmetic applicator brush (24) with more than two zones (16), (18) and (26) may be manufactured. In such a case, each zone has a differently defined pitch between adjacent fiber arrays, and as such each zone has mascara loading capabilities. In this figure, a cosmetic applicator brush (24) has a first zone (16), a second zone (18) and a third zone (26), as shown. The pitch between adjacent fiber arrays (14) within each of the first (16), second (18) and third (26) zones is constant as shown by P1, P2 and P9, but the pitch between each of the zones differs.

Figure 1C:
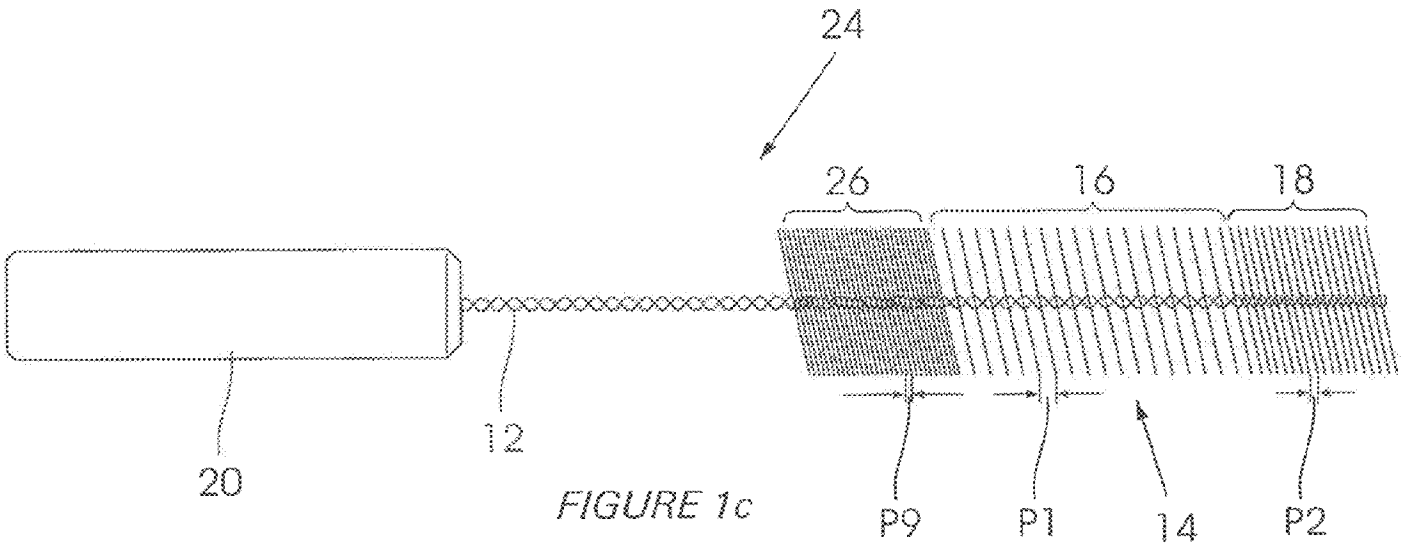
Figure 1D:
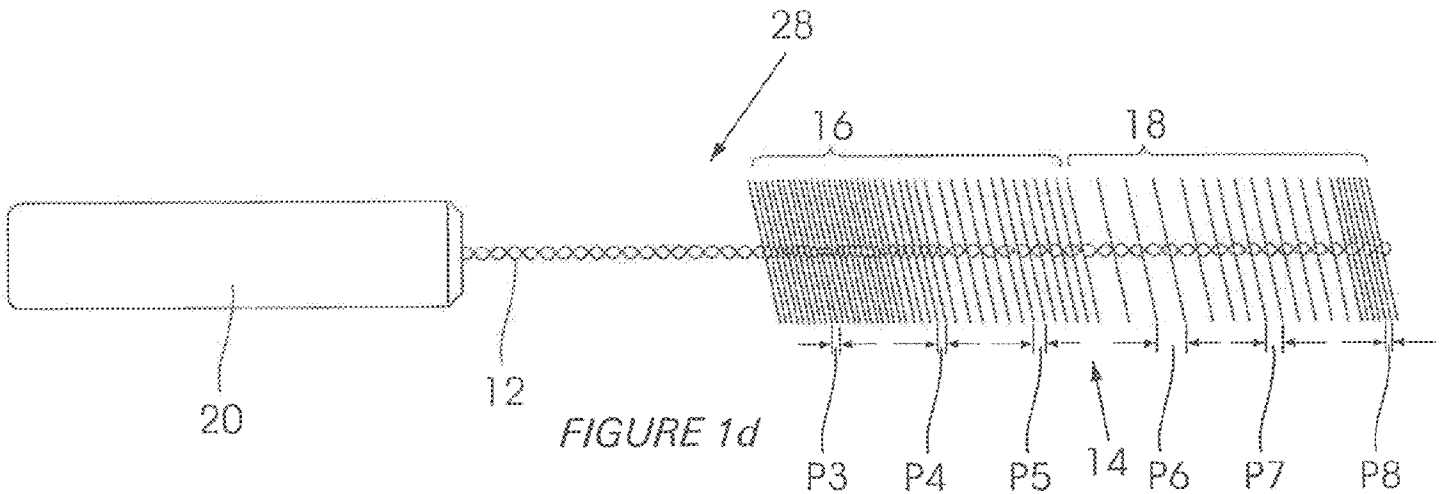

In yet a further version, a brush (28), as shown in FIG. 1*d*, comprises a plurality of pitches (P3, P4, P5) between adjacent fiber arrays (14) located within the first zone (16), and a plurality of pitches (P6, P7, P8) between adjacent fiber arrays (14) located within the second zone (18). Thus, in this embodiment, the pitch of the brush varies linearly within zones, as well as linearly between zones.

Although not shown, it is envisaged that a cosmetic applicator brush with at least two zones, one of the zones having a variable pitch between adjacent fiber arrays and the other zone having a constant pitch between adjacent fiber arrays, may also be manufactured.

Figure 2:
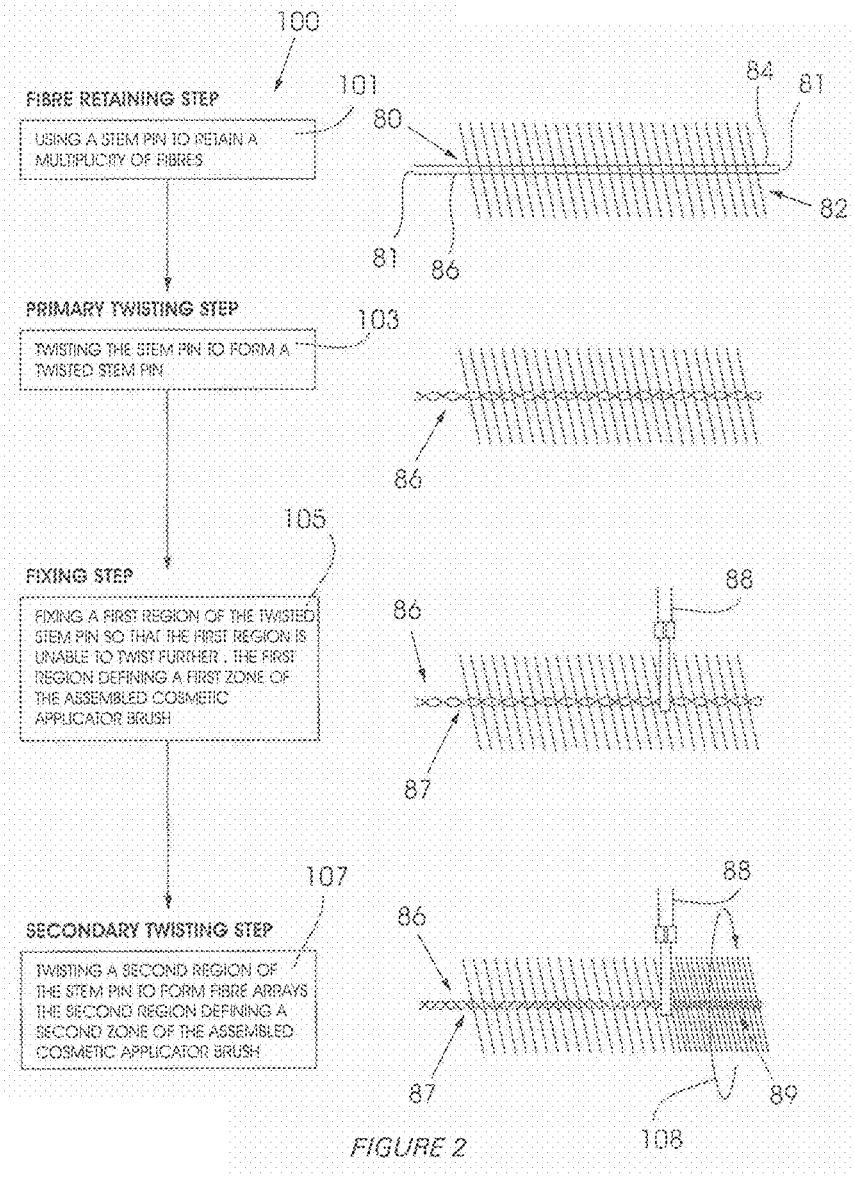
FIG. 2 is a flow diagram, and associated configurations, representing a method of manufacturing a cosmetic applicator brush in accordance with a second aspect of the invention.

In FIG. 2, a method 100 of manufacturing a cosmetic applicator brush, in accordance with a second aspect of the invention is shown. A stem pin (80) is used to retain a multiplicity of fibers (82), in a fiber retaining step (101). To do this, the stem pin (80) is bent and folded back so that the multiplicity of fibers (82) is sandwiched between a first side (84) and a second side (86) of the stem pin (80), and thereby retained between the two sides of the stem pin (80).

As shown, the fibers (82) are placed between the two sides of the stem pin (80) in a uniform manner so that the fiber density along the applicator brush length is constant. Alternatively, the fibers (82) may be placed between the two sides of the stem pin (80) in a non-uniform manner so that the fiber density along the applicator brush length is variable. Where a uniform distribution of fibers is used, and the stem pin (80) is twisted, according to the twisting steps explained below, a constant pitch will be defined between adjacent fiber arrays within a defined fiber zone. Conversely, where a non-uniform distribution of fibers is used, and the stem pin (80) is twisted, the pitch between adjacent fiber arrays within a defined zone will vary. To achieve a non-uniform distribution of fibers within the stem pin (80), the fibers (82) can either be rearranged within the stem pin (80) prior to the twisting of the pin, as described below, or additional fibers can be added to a certain region of the stem pin (80) such that there are more fibers within that region.

In a primary twisting step (103), the stem pin (80) is twisted, in a rotational device, to form a twisted stem pin (86). The rotational device grips both ends (81) of the stem pin (80) and then rotates and twists the stem pin (80). The stem pin (80) is generally twisted between 12 and 20 times, when a cosmetic applicator brush of 25 mm is produced. It has been found that when the stem pin (80) is twisted less than 11 times the multiplicity of fibers (82) are not anchored sufficiently, and may fall loose. Conversely, when the stem pin (80) is twisted more than 20 times, the stem pin (80) tends to crush the fibers (82). Clearly, if the stem pin (80) is twisted 20 times during the primary twisting step (103), secondary twisting, which will be described further below, will not be possible (if a 25 mm brush is being produced) as this will result in damage to the multiplicity of fibers (82). As such, the stem pin (80) is generally twisted between 11 and 18 times during the primary twisting step (103). It is envisaged that more or less twists may be applied in the primary twisting step (103) when cosmetic applicator brushes of different lengths are produced.

In a fixing step (105) a first region (87) of the twisted stem pin (86) is clamped using a clamp (88). The clamping of the first region (87) prevents the first region (87) from rotating and twisting further during subsequent steps of the manufacturing method. The first region (87) thus defines a first zone of an assembled cosmetic applicator brush, corresponding to the first zone (16) shown in FIGS. 1*a*, 1*b* and 1*d*.

It is also envisaged that, where a cosmetic applicator brush having more than two regions is to be manufactured, more than one clamp (88) may be used. Where more than one clamp (88) is used, at least one fixed region will be defined between the clamps. The fixed region will thus be unable to rotate during subsequent twisting steps, and the regions which are not fixed will be able to twist in further twisting steps, in a similar manner to the twisting step described immediately here below. Such a method, in which two clamps are applied, is used to manufacture the brush (28) in FIG. 1*d*.

In a secondary twisting step (107), as indicated by arrow (108), a second region (89) of the twisted stem pin (86) is twisted further. The first region (87) is unable to twist due to the fact that it has been clamped, as explained above with reference to the fixing step (105). In the secondary twisting step (107), the second region (89) can be twisted such that the number of additional twists in the second region (89) does not exceed 10, given that a total of 20 twists is sustainable before any damage is caused to the multiplicity of fibers. For example, if during the primary twisting step (103), the stem pin (80) is twisted 12 times, the first region (87) has 6 twists and the second region (89) has 6 twists. Thus, during the secondary twisting step (107) the second region (89) can only be twisted a further 4 times. Therefore, as can be seen in the example above, the number of additional twists that the stem pin (80) can sustain during the secondary twisting step (107) must be calculated bearing in mind the number of twists applied to that region of the stem pin (80) during the primary twisting step (103). Preferably, during the second twisting step, the stem pin (80) is twisted between 1 and 5 times. The second region (89) becomes a second zone of an assembled cosmetic applicator brush, in this instance the second zone being similar to the second zone (18) shown in FIG. 1*a*.

It is envisaged that where more than two zones are to be produced to produce, for example, the brush (24) in FIG. 1*c*, a number of further fixing steps and further twisting steps will be required to vary and define the pitch of subsequent zones.

The method as described above is either automated and occurs in line, such that each step occurs in the same device, or the primary twisting step (103) is done separately from the secondary twisting step (107) at different locations and using different machinery.

The multiplicity of fibers (82) can be trimmed after the primary twisting step (103), and then the secondary twisting (107) step can be performed separately. Alternatively, trimming can occur after the secondary twisting step (107) has been performed, such the multiplicity of fibers, which after secondary twisting are distributed as fiber arrays, are trimmed. In the automated process, trimming will take place after the secondary twisting step (107), and in this case the rotational device, on which the stem pin (80) is mounted, will continue to turn, without twisting the stem pin (80), and a cutter will approach the stem pin (80) and trim the fiber arrays so as to form the assembled brush.

The present invention thus provides a cosmetic applicator brush with defined zones, each zone having either a fixed or a variable pitch between adjacent fiber arrays located within the zones, to enable the amount and distribution of mascara loaded onto the brush to be varied.

The invention claimed is:

1. A method of manufacturing a cosmetic applicator brush, the method comprising:

using a stem pin to retain a multiplicity of fibers;

in a primary twisting step, twisting the stem pin to form a twisted stem pin with a plurality of fiber arrays extending from the twisted stem pin;

fixing a first region of the twisted stem pin, such that said first region is unable to twist further, the first region defining at least a first zone of the cosmetic applicator brush, the at least first zone in turn defining at least a first pitch between adjacent fiber arrays located within the first zone; and in a secondary twisting step, further twisting a second region of the twisted stem pin to define at least a second zone of the cosmetic applicator brush, the at least second zone in turn defining at least a second pitch between adjacent fiber arrays located within the second zone, with the at least first pitch being different to the at least second pitch;

wherein the fiber arrays are trimmed between the primary and the secondary twisting step.

2. A method of manufacturing a cosmetic applicator brush, as claimed in claim 1, wherein the fibers of at least one of the first and second zones are retained in a uniform distribution such that a fiber density along an applicator brush length is constant.

3. A method of manufacturing a cosmetic applicator brush, as claimed in claim 1, wherein the fibers of at least one of the first and second zones are is retained in a non-uniform distribution such that fiber density along an applicator brush length is variable.

4. A method of manufacturing a cosmetic applicator brush, as claimed in claim 1, wherein the stem pin, in the primary twisting step, is twisted between 11 and 18 times.

5. A method of manufacturing a cosmetic applicator brush, as claimed in claim 1, wherein the stem pin, in the secondary twisting step, is twisted between 1 and 5 times.

6. A method of manufacturing a cosmetic applicator brush, as claimed in claim 2, wherein the stem pin, in the primary twisting step, is twisted between 11 and 18 times.

7. A method of manufacturing a cosmetic applicator brush, as claimed in claim 3, wherein the stem pin, in the primary twisting step, is twisted between 11 and 18 times.

8. A method of manufacturing a cosmetic applicator brush, as claimed in claim 3, wherein the stem pin, in the secondary twisting step, is twisted between 1 and 5 times.

9. A method of manufacturing a cosmetic applicator brush, as claimed in claim 3, wherein the stem pin, in the secondary twisting step, is twisted between 1 and 5 times.

* * * * *